US011215076B2

(12) United States Patent
Boehme et al.

(10) Patent No.: US 11,215,076 B2
(45) Date of Patent: Jan. 4, 2022

(54) BEARING DEVICE FOR LOAD REDUCTION

(71) Applicant: Rolls-Royce Deutschland Ltd & Co KG, Blankenfelde-Mahlow (DE)

(72) Inventors: Martin Boehme, Berlin (DE); Timo Schatke, Dresden (DE)

(73) Assignee: ROLLS-ROYCE DEUTSCHLAND LTD & CO. KG, Blankenfelde-Mahlow (DE)

( * ) Notice: Subject to any disclaimer, the term of this patent is extended or adjusted under 35 U.S.C. 154(b) by 323 days.

(21) Appl. No.: 16/451,997

(22) Filed: Jun. 25, 2019

(65) Prior Publication Data

US 2020/0003075 A1 Jan. 2, 2020

(30) Foreign Application Priority Data

Jul. 2, 2018 (DE) ..... 10 2018 116 018.6

(51) Int. Cl.
*F01D 25/16* (2006.01)
*F01D 25/06* (2006.01)
*F01D 5/02* (2006.01)

(52) U.S. Cl.
CPC ..... *F01D 25/16* (2013.01); *F01D 25/06* (2013.01); *F01D 5/02* (2013.01); *F05D 2220/323* (2013.01); *F05D 2240/50* (2013.01); *F05D 2260/96* (2013.01)

(58) Field of Classification Search
CPC ..... F01D 25/16; F01D 25/06; F01D 25/045; F01D 25/04; F05D 2240/50
See application file for complete search history.

(56) References Cited

U.S. PATENT DOCUMENTS 4,313,712 A * 2/1982 Briggs ..... F01D 25/16 416/2
4,375,906 A 3/1983 Roberts et al.
4,452,567 A * 6/1984 Treby ..... F01D 5/026 415/9

(Continued)

FOREIGN PATENT DOCUMENTS

DE 3124462 A1 3/1982
DE 10202977 C1 10/2003
EP 3006680 B1 1/2018

OTHER PUBLICATIONS

German Search Report dated Mar. 11, 2019 for counterpart German Patent Application No. 10 2018 116 018.6.

(Continued)

*Primary Examiner* — Michael L Sehn
(74) *Attorney, Agent, or Firm* — Shuttleworth & Ingersoll, PLC; Timothy Klima

(57) ABSTRACT

A bearing assembly for a gas turbine engine comprises a bearing; a bearing bracket, which holds the bearing and is secured by a predetermined breaking device on a connecting element, which can be connected or is connected to a support structure of the gas turbine engine; and a clutch for transmitting a torque from a first clutch element connected in a fixed manner to the rotor of the bearing to a second clutch element supported on the bearing bracket, wherein the clutch elements are spaced apart when the predetermined breaking device is intact and can be brought into contact with one another by destruction of the predetermined breaking device. A gas turbine engine and a method are furthermore provided.

16 Claims, 8 Drawing Sheets

(56) References Cited

U.S. PATENT DOCUMENTS

| | | | | |
|---|---|---|---|---|
| 7,404,678 | B2 | 7/2008 | Plona | |
| 7,524,112 | B2 | 4/2009 | Gerez et al. | |
| 9,777,596 | B2 | 10/2017 | Raykowski et al. | |
| 2003/0142894 | A1 | 7/2003 | Woehrl | |
| 2016/0097301 | A1 | 4/2016 | Rosenau et al. | |
| 2016/0130975 | A1* | 5/2016 | Chilton | F01D 25/24 415/9 |
| 2017/0009603 | A1 | 1/2017 | Carter et al. | |
| 2017/0234157 | A1 | 8/2017 | Khan et al. | |

OTHER PUBLICATIONS

German Search Report dated Mar. 11, 2019 for counterpart German Patent Application No. 10 2018 116 019.4.

* cited by examiner

BEARING DEVICE FOR LOAD REDUCTION

This application claims priority to German Patent Application DE102018116018.6 filed Jul. 2, 2018, the entirety of which is incorporated by reference herein.

The present disclosure relates to a bearing assembly for a gas turbine engine, to a gas turbine engine and to a method for producing a bearing assembly according to the present disclosure.

If a bearing which supports a component movably on another component is subjected to a force which exceeds the rated load capacity, the bearing and adjoining parts may be damaged. In the case of rotatable support, loads of this kind can be generated, for example, by an unbalance, in particular an unbalance which arises suddenly.

The loss of a fan blade of a gas turbine engine during operation (a "fan blade off event") is usually associated with a particularly severe unbalance, for example. This unbalance results in corresponding radial loads, especially on a bearing adjacent to the fan of a shaft driving the fan and a support structure of the gas turbine engine. Through an appropriate outlay on materials, for example, gas turbine engines can be configured to withstand such loads.

One possibility for reducing loads immediately after the loss of the fan blade is to use shear pins which connect the bearing to the support structure and which break when a maximum load capacity is exceeded. A backup bearing arranged offset relative to the bearing can then ensure the radial positioning of the shaft. For reliable retention of the shaft, this backup bearing is of appropriately robust design, this being reflected, in turn, in the overall weight.

One possible effect of such an arrangement is furthermore a change in the resonant frequency of the shaft after the breakage of the shear pins. In the case of many gas turbine engines, this is in the range of the fan's "windmilling" speed during the flight of an aircraft. Windmilling refers to the turbine-equivalent behavior of the fan as it is driven by air flowing through the engine. A resonance excited in this way can cause severe vibration, which imposes stress not only on the gas turbine engine but also on the connection thereof to the aircraft and on the aircraft. This is counteracted, for example, by specific flying maneuvers after blade loss, fine tuning the resonant frequency of other components and a corresponding outlay on materials in the production of structural components.

It is the object of the present invention to make available a bearing assembly which allows reliable support, especially of a shaft, with a minimum weight.

According to one aspect, a bearing assembly for a gas turbine engine is made available. The bearing assembly comprises a bearing having a stator and a rotor rotatable relative to the stator. The bearing assembly furthermore comprises a bearing bracket holding the bearing (particularly holding the stator, for example by being connected in a fixed manner to the stator). The bearing bracket is connected in a fixed manner, by a predetermined breaking device, to a connecting element, which is designed to be connected to a support structure of the gas turbine engine, and is optionally connected thereto. The bearing assembly furthermore comprises a clutch. The clutch is designed to transmit a torque from a first clutch element, which is connected in a fixed manner to the rotor of the bearing, to a second clutch element, which is supported on the bearing bracket (in particular rotatably). The clutch elements are designed and arranged in such a way that they are spaced apart when the predetermined breaking device is intact and can be brought into contact, in particular into surface contact, with one another as a result of destruction of the predetermined breaking device.

A bearing assembly which has a clutch of this kind can be used, for example, to re-establish the original bearing configuration after the predetermined breaking device has been destroyed (and a speed of revolution of the rotor has, optionally, already decreased). This re-established bearing configuration can change the natural frequency of the shaft and thus ensure an adequate frequency offset between the excitation frequency and the natural frequency, with the result that the shaft does not rotate in the resonant range during windmilling. Thus, it is possible to reduce loads and, in this way, to enable particularly reliable support of the shaft.

The clutch is designed as a friction clutch, for example. The clutch elements are each designed as a clutch plate, in particular as a clutch disk, for example. The clutch elements are aligned coaxially with one another, for example.

A wearing element, e.g. an annular wearing element, which can be worn by the action of at least one of the two clutch elements, is optionally arranged between the two clutch elements. For example, it is designed in such a way that it is successively worn through when at least one of the clutch elements rubs against it. The wearing element is produced from a material which wears more easily (e.g. is softer) than one of the clutch elements or both clutch elements, for example. The wearing element prevents torque transmission from one clutch element to the other if it is not yet worn. The wearing element makes it possible to delay torque transmission via the clutch elements after destruction of the predetermined breaking device. In this period of time, loads can be dissipated and the speed of the rotor reduced. The period of time can be adjustable, e.g. by way of the thickness of the wearing element, the material, lubrication etc. Provision can be made for the thickness of the wearing element to be adapted or adaptable to the respective gas turbine engine.

In one embodiment, the bearing assembly comprises a fixing device for fixing, in particular radially fixing, the bearing bracket on the connecting element, said fixing device being drivable by the clutch. Driven by the clutch, the bearing can thereby once again be connected in a fixed manner to the support structure after a large proportion of the loads has been dissipated by destruction of the predetermined breaking device after a case of an overload. By means of the bearing assembly, it is thus possible to absorb the greatest load peaks by destruction of the predetermined breaking device after an exceptional event (e.g. the loss of a fan blade) and then, after a predetermined period of time, to re-connect the initially movable bearing bracket in a fixed manner to the connecting element. In the case of a gas turbine engine, the rotational speed of the supported shaft generally decreases during this period of time, in particular owing to the fuel supply being switched off. After a decrease in the radial loads (and optionally before a renewed rise caused by resonance due to windmilling), the bearing bracket and connecting element are fixed to one another again. This allows particularly reliable support for the shaft and makes it possible to reduce the amplitude of the forces transmitted into the structure. Moreover, an optional backup bearing has to hold the shaft only for a short period of time and, accordingly, can be produced and installed with a lower outlay on materials. In other words, a torque transmitted via the clutch can be used to rotate two components of mutually matched shape. Nonpositive engagement can arise as a result, and loads can once again be transmitted via the bearing bracket and the connecting element.

In a development, the fixing device comprises an outer component and an inner component arranged at least partially and optionally completely within the outer component. In the initial position with the predetermined breaking device intact, there may be play between the outer component and the inner component due to a radial gap or clearance. This gap or clearance can be set in such a way that the rotor can orbit freely with the inner component within the outer component (within the play) after the destruction of the predetermined breaking device before the clutch fixes the inner component again on the outer component.

It is possible for the inner component to be rotatable relative to the outer component by means of the clutch when the clutch elements are in contact with one another (owing to destruction of the predetermined breaking device). Relative movement between the outer component and the bearing bracket is possible (only) after the destruction of the predetermined breaking device.

In one embodiment, the inner component has at least one projection. The outer component can have at least one socket. The socket can be designed to receive the projection. The fixing device can be designed in such a way that the inner component is movable relative to the outer component as long as the projection is arranged in the socket. If the predetermined breaking device is destroyed by an unbalance of a shaft supported by means of the bearing assembly, this unbalance can then lead to an orbiting motion of the shaft. This orbiting motion can cause deeper engagement of the projection in the socket in order to facilitate successive fixing of the inner component on the outer component. It is thus possible to make active use of an orbiting motion caused by an unbalance.

In a development, the projection can be pushed against a stop of the outer component by rotation of the inner component relative to the outer component, in particular in such a way that the bearing bracket is fixed thereby on the connecting element.

The projection and the stop and/or a region of the outer component which is adjacent to the stop can be designed to jointly fix the inner component frictionally or in some other way on the outer component.

As an option, the outer component can be provided with a coating (in particular a friction-increasing coating) and/or with positive engagement elements and/or a transition fit in the region of the stop. In this way, the inner component can be fixed in a particularly secure manner.

In one embodiment, at least two sockets of the outer component have different lengths from one another in the circumferential direction (around the axis of rotation of the rotor of the bearing relative to the stator of the bearing). A tumbling inward rotation of the inner component on the outer component, for example, is thereby possible, e.g. in order successively to fix it thereon.

As an option, a plurality of sockets of the same length is provided, wherein the sockets of the same length are arranged adjacent to one another. In particular, such an arrangement makes it possible to exploit a deflection of the shaft due to an unbalance to fix the fixing device.

The second clutch element can be connected in a fixed manner to the inner component or formed thereon. As an alternative or in addition, the inner component can be supported rotatably on the bearing bracket.

In one embodiment, the bearing assembly comprises a lubricant feed. The lubricant feed can be configured to introduce lubricant between the inner component and the bearing bracket. It is thereby possible to achieve particularly smooth rotatability of the inner component on the bearing bracket.

According to one aspect, a gas turbine engine, in particular a gas turbine engine for an aircraft, is made available. The gas turbine engine comprises at least one bearing assembly according to any embodiment described herein. The gas turbine engine can furthermore comprise a fan driven by a shaft of the gas turbine engine. In this case, the bearing of the bearing assembly can rotatably support the shaft.

In this way, it is possible to make available a gas turbine engine which allows reliable support of the shaft with a minimum weight. By reconnecting the bearing to the support structure of the gas turbine engine, an aircraft which has the gas turbine engine can remain safely in the air for a relatively long period of time without the occurrence of severe vibration and loads, even after a fan blade off event.

According to one aspect, a method for producing a bearing assembly for a gas turbine engine, in particular for producing a bearing assembly according to any embodiment described herein, is made available. The method comprises the following steps (optionally but not necessarily in this order): First step: making available a bearing having a stator and a rotor rotatable relative thereto and a bearing bracket, which holds the bearing (in particular the stator) and is secured by a predetermined breaking device on a connecting element, which can be connected or is connected to a support structure of the gas turbine engine. Second step: arranging a clutch for transmitting a torque from a first clutch element connected for conjoint rotation to the rotor of the bearing to a second clutch element supported on the bearing bracket, wherein the clutch elements are spaced apart when the predetermined breaking device is intact and can be brought into contact, in particular into surface contact, with one another by destruction of the predetermined breaking device.

The method can furthermore comprise the following steps:

- optionally: specifying a period of time from destruction of the predetermined breaking device, in particular until intended re-newed fixing of the bearing bracket on the connecting element;
- optionally: specifying forces acting on the clutch after the destruction of the predetermined breaking device and/or adapting the occurring frictional forces in the contact between the inner and the outer component; and
- making available a wearing element, which is optionally structured and dimensioned in such a way that it has worn away after a period of time corresponding to the specified period of time when the forces which act on the clutch after the destruction of the predetermined breaking device take effect. The wearing element can be arranged between the two clutch elements and prevents the two clutch elements from entering into contact in the specified period of time.

Thus, in particular, reconnection of the bearing within a time matched to a particular gas turbine engine is possible, thereby making it possible to cope with an overload in a particularly reliable manner.

A person skilled in the art will understand that a feature or parameter which is described in relation to one of the above aspects can be applied with any other aspect, unless they are mutually exclusive. Moreover, any feature or any parameter which is described here can be applied with any aspect and/or can be combined with any other feature or parameter described here, unless they are mutually exclusive.

Embodiments are now described by way of example with reference to the figures; in the figures.

Figure 1:
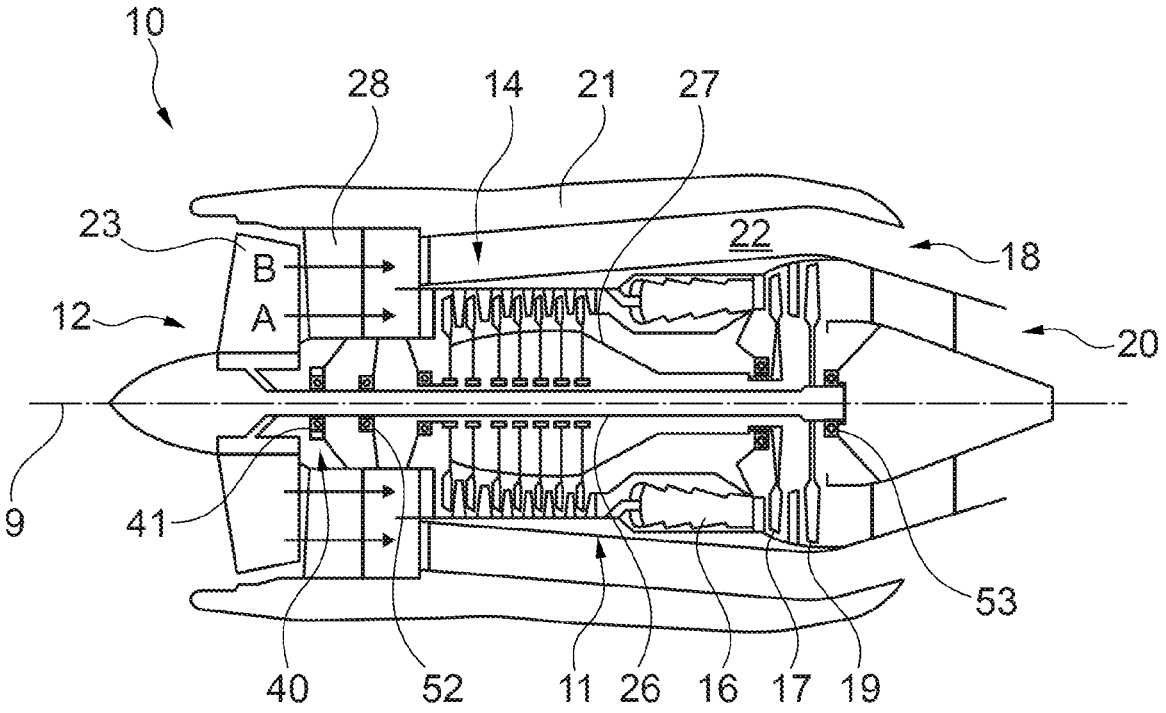
FIG. 1 shows a sectional view from the side of a gas turbine engine.

FIG. 1 represents a gas turbine engine 10 having a main axis of rotation 9. The gas turbine engine 10 comprises an air inlet 12 and a fan 23, which produces two air flows: a core air flow A and a bypass air flow B. The gas turbine engine 10 comprises a core engine 11, which receives the core air flow A. The core engine 11 comprises, in the sequence of axial flow, a compressor 14 (optionally divided into a low-pressure compressor and a high-pressure compressor), a combustion device 16, a high-pressure turbine 17, a low-pressure turbine 19 and a core thrust nozzle 20. An engine nacelle 21 surrounds the gas turbine engine 10 and defines a bypass duct 22 and a bypass thrust nozzle 18. The bypass air flow B flows through the bypass duct 22. The fan 23 is mounted on the low-pressure turbine 19 by means of a shaft 26 and is driven by said turbine.

During operation, the core air flow A is accelerated and compressed by the compressor 14. The compressed air expelled from the compressor 14 is introduced into the combustion device 16, where it is mixed with fuel and the mixture is burnt. The resulting hot combustion products then propagate through the high-pressure and the low-pressure turbine 17, 19 and thereby drive said turbines, before they are expelled through the nozzle 20 to provide a certain thrust. The high-pressure turbine 17 drives the compressor 14 by means of a suitable connecting shaft 27. Generally speaking, the fan 23 provides the majority of the thrust.

Other gas turbine engines in which the present disclosure can be used can have alternative configurations. For example, engines of this kind can have an alternative number of compressors and/or turbines and/or an alternative number of connecting shafts. As a further example, the gas turbine engine shown in FIG. 1 has a split flow nozzle 20, 22, which means that the flow through the bypass duct 22 has a dedicated nozzle, which is separate from the engine core nozzle 20 and is radially on the outside with respect to the latter. However, this is not restrictive, and any aspect of the present disclosure can also apply to engines in which the flow through the bypass duct 22 and the flow through the core 11 are mixed or combined before (or upstream of) a single nozzle, which can be referred to as a mixed flow nozzle. One or both nozzles (whether mixed-flow or split flow) can have a fixed or variable area. Although the example described relates to a turbofan engine, the disclosure can be used, for example, in any type of gas turbine engine, e.g. an open-rotor engine (in which the fan stage is not surrounded by an engine nacelle) or a turboprop engine.

The geometry of the gas turbine engine 10 and components thereof is/are defined by a conventional axis system which comprises an axial direction (which is aligned with the axis of rotation 9), a radial direction (in the direction from the bottom up in FIG. 1) and a circumferential direction (perpendicular to the view in FIG. 1). The axial, the radial and the circumferential directions are mutually perpendicular.

The gas turbine engine 10 comprises a bearing assembly 40. By means of the bearing assembly 40, the shaft 26 (which drives the fan 23) is supported rotatably on a support structure 28 of the gas turbine engine 10. The support structure is secured on the engine nacelle 21, for example. The bearing assembly 40 has a plurality of bearings, in the present example three bearings 41, 52, 53. One bearing 41 is arranged adjacent to the fan 23. In the present example, this bearing 41 is designed as a fixed bearing and can therefore transmit axial forces, although bearing 41 can also, in principle, be designed as a floating bearing. A further bearing 52 arranged downstream thereof is designed as a backup bearing. This bearing 52 is designed to provide the shaft 26 with reliable support, even if the bearing 41 arranged adjacent to the fan 23 is separated from the support structure 28, e.g. owing to the loss of a fan blade of the fan 23 during the operation of the gas turbine engine 10. At its end remote from the fan 23, the shaft 26 is supported rotatably on the support structure 28 by means of a third bearing 53. This bearing 53 has rolling elements in the form of rollers, for example.

Figure 2:
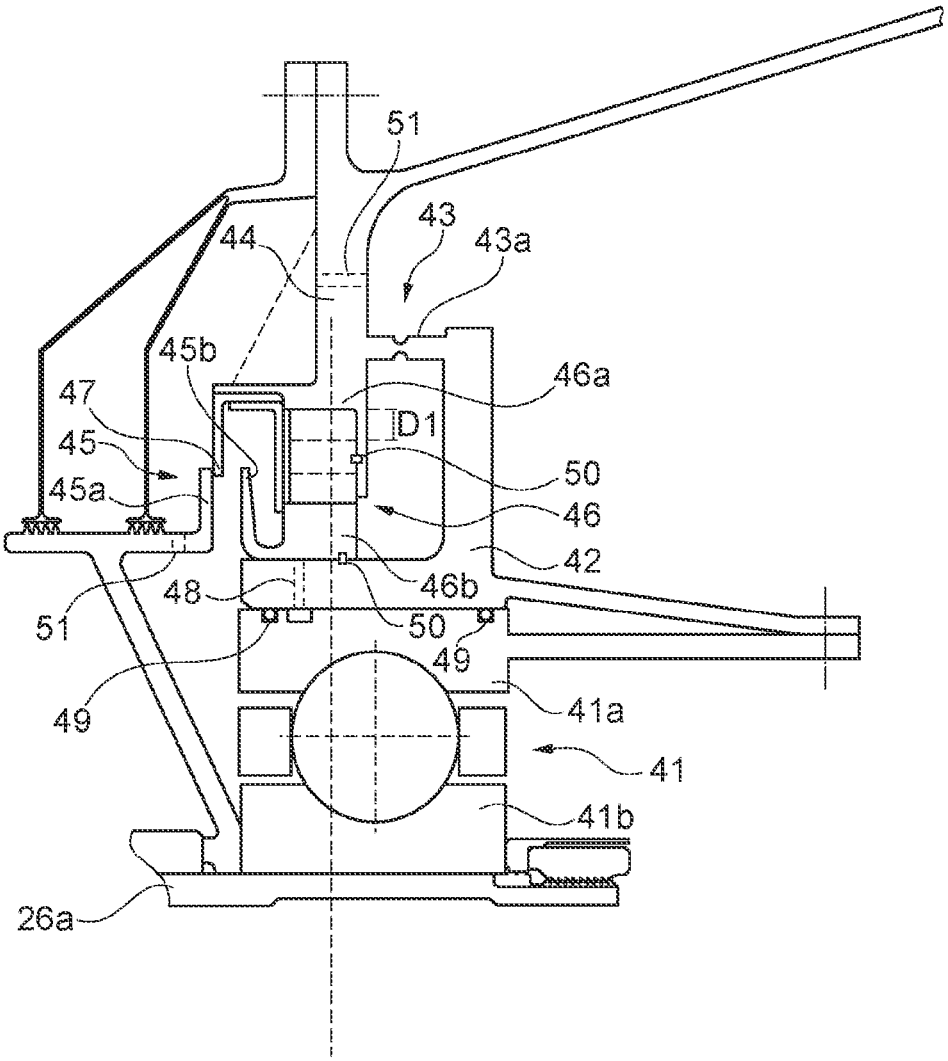
FIG. 2 shows an enlarged sectional view from the side of a part of the gas turbine engine having a bearing assembly.

FIG. 2 shows, in particular, the bearing 41 adjacent to the fan 23 and further elements of the bearing assembly 40.

Bearing 41 comprises a component which is fixed relative to the support structure 28. This component is referred to below as stator 41*a*. Bearing 41 furthermore comprises a component which is rotatable relative to the support structure 28. This component is referred to below as rotor 41*b*. The rotor 41*b* is secured on a connecting element 26*a* of the shaft 26, said connecting element being connected in a fixed manner to the shaft 26. Bearing 41 comprises a plurality of rolling elements, bearing 41 being a ball bearing in the example shown. It comprises balls which are arranged in a cage and support the rotor 41*b* rotatably within the stator 41*a*.

The stator 41*a* is mounted in a fixed manner on a bearing bracket 42, in the present case by means of two axially projecting flanges, although an integral design is also conceivable. The stator 41*a* is arranged within the bearing bracket 42. The bearing bracket 42 is secured on a connecting element 44 by means of a predetermined breaking device 43, in the example shown by means of a radially outward-projecting (disk-shaped) section of the bearing bracket 42. The bearing bracket 42 and the predetermined breaking device 43 and the connecting element 44 can be formed integrally with one another or, alternatively, mounted one on the other. In the example shown, the predetermined breaking device 43 comprises a multiplicity of shear pins 43*a*, which fail, e.g. fragment, when a specified (in particular radial) load is exceeded. The shear pins 43*a* extend in the axial direction. The connecting element 44 is mounted in a fixed manner on the support structure 28 (not illustrated in FIG. 2) of the gas turbine engine 10 (see FIG. 1). As an option, the connecting element 44 forms part of the support structure 28.

The bearing assembly 40 furthermore comprises a clutch 45 and a fixing device 46. The clutch 45 is designed as a friction clutch. The clutch 45 comprises a first clutch element in the form of a first (annular) clutch plate 45*a* and a second clutch element in the form of a second (annular) clutch plate 45*b*. The two clutch plates 45*a*, 45*b* are each of disk-shaped design with a central aperture for the shaft 26.

The clutch plates 45*a*, 45*b* are arranged coaxially with one another. One or both of the clutch plates 45*a*, 45*b* optionally comprises a friction lining.

The first clutch plate 45*a* is connected in a fixed manner to a bracket (here formed integrally therewith but alternatively mounted thereon), which is connected in a fixed manner to the rotor 41*b* of the bearing 41 and to the shaft 26 (in this case via the connecting element 26*a*). The second clutch plate 45*b* is provided on an inner component 46*b* (explained in greater detail below) of the fixing device 46.

In the state shown in FIG. 2, with an intact predetermined breaking device 43, the two clutch plates 45*a*, 45*b* are spaced apart axially. The mutually facing surfaces thereof are aligned parallel to one another.

A wearing element 47 is arranged between the clutch plates 45*a*, 45*b*. The wearing element is part of a component of L-shaped cross section, wherein one leg is secured on the connecting element 44 (specifically on an annular, projecting extension) and the other leg projects into the interspace between the clutch plates 45*a*, 45*b*. Here, the connecting element 44 has (optional) reinforcing ribs, indicated by means of a dashed line in FIG. 2, which support the annular, projecting section in the example shown.

If an overload on the bearing 41 leads to destruction of the predetermined breaking device 43, the bearing bracket 42 can be moved at least axially relative to the connecting element 44. Mobility in the circumferential direction is limited or substantially prevented by corresponding boundaries (not shown in the figures). During the operation of the gas turbine engine 10, the low-pressure turbine 19 exerts a tension on the shaft 26 and, after the destruction of the predetermined breaking device, this leads to the first clutch plate 45*a* being pulled axially in the direction of the second clutch plate 45*b*. An air pressure acting on the fan 23 can also push the shaft 26 in this direction. A corresponding movement of the first clutch plate 45*a* relative to the second clutch plate 45*b* is initially blocked by the wearing element 47, however.

The wearing element 47 is manufactured from a material which can be worn away by the action of the first clutch plate 45*a* (which rotates with the shaft 26). After the destruction of the predetermined breaking device 43, therefore, the rotating first clutch plate 45*a* is pressed against the wearing element 47. During this process, material is progressively worn away from the wearing element 47. As soon as the first clutch plate 45*a* has worn through the wearing element 47, the axial force on the shaft 26 has the effect that the clutch plates 45*a*, 45*b* are brought into contact with one another and pressed against one another. Thus, a torque on the shaft 26 is transmitted to the second clutch plate 45*b*. The first clutch plate 45*a* takes the second clutch plate 45*b* along in rotation relative to the connecting element 44.

In the example shown, the second clutch plate 45*b* is formed integrally with the already mentioned inner component 46*b* of the fixing device 46 (alternatively being secured thereon). The inner component 46*b* and hence the second clutch plate 45*b* are supported rotatably on the bearing bracket 42. Action of the first clutch plate 45*a* on the second clutch plate 45*b* thus has the effect that the inner component 46*b* rotates in a sliding manner on the bearing bracket 42. As an option, a lock 50 is provided, preventing rotation of the inner component 46*b* relative to the bearing bracket 42 during normal operation. As soon as the clutch 45 transmits a torque, this lock 50 breaks. The lock is a pin that can be sheared off, for example.

In the example shown, the inner component 46*b* is also supported in an axially movable manner on the bearing bracket 42.

The fixing device 46 furthermore comprises an outer component 46*a* which accommodates the inner component 46*b*. A radially inward-projecting section of the outer component 46*a* and a holding disk prevent axial movement of the inner component 46*b* relative to the outer component 46*a* on both sides. It is thus impossible for the inner component 46*b* to be displaced axially relative to the outer component 46*a*. The outer component 46*a* serves as a bearing housing for the inner component 46*b*.

In the initial position shown in FIG. 2, an optional lock 50 prevents the inner component 46*b* from performing a rotation relative to the outer component 46*a* during normal operation of the gas turbine engine 10 (before an overload event) (e.g. by means of axially projecting teeth in engagement with the inner component 46*b* and the outer component 46*a*). The lock 50 is a pin which can be sheared off, for example. The lock 50 serves as an anti-rotation component. After the predetermined breaking device 42 fails, the lock 50 breaks and allows rotation of the inner component 46*b* relative to the outer component 46*a*.

This rotation is then driven by the clutch 45 in order to connect the bearing 41 firmly to the support structure 28 again by means of the fixing device 46.

Figure 3A:
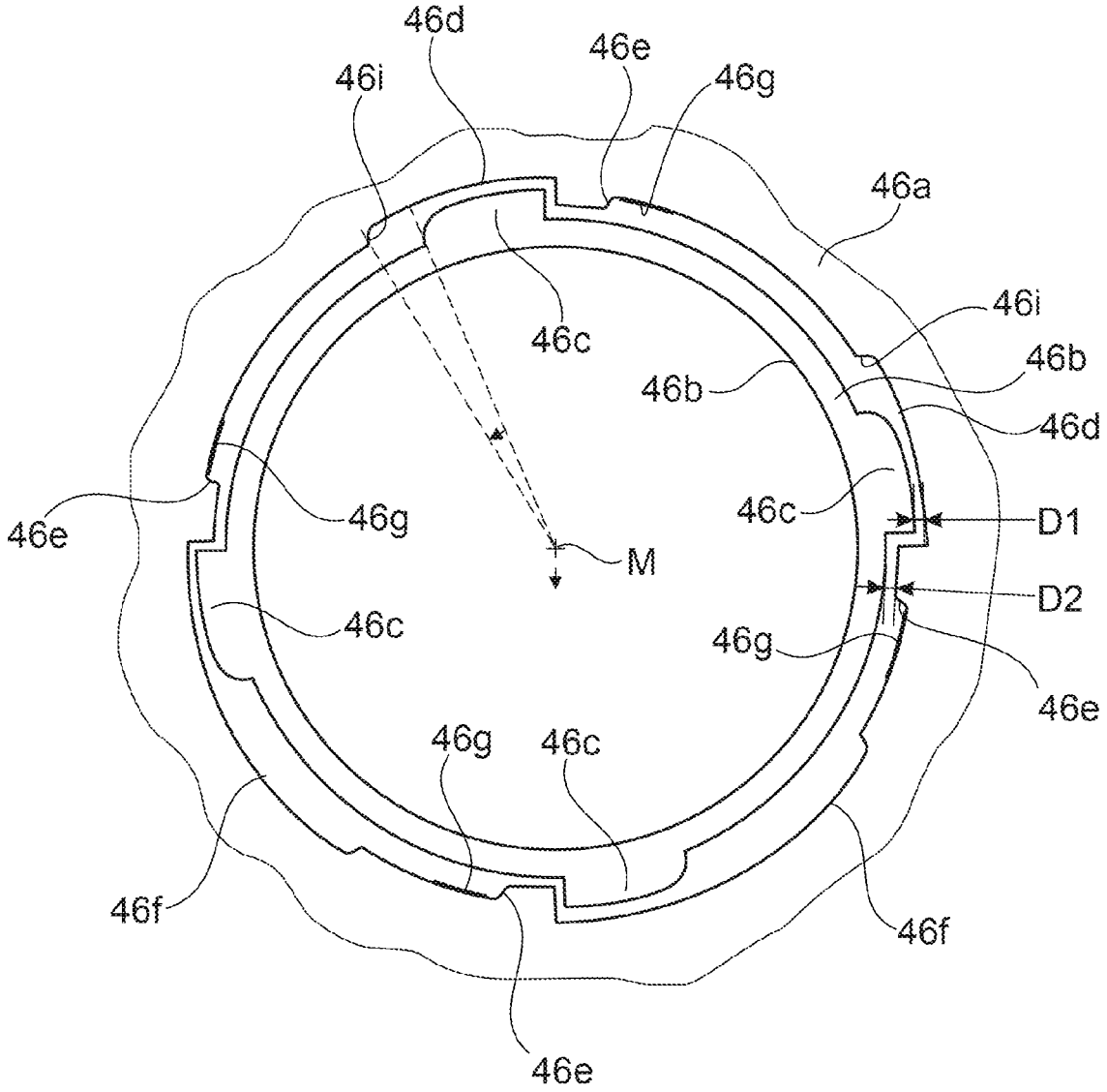
FIGS. 3A to 3C show a cross-sectional view of a fixing device of the bearing assembly of the gas turbine engine at various stages.
Figure 3B:
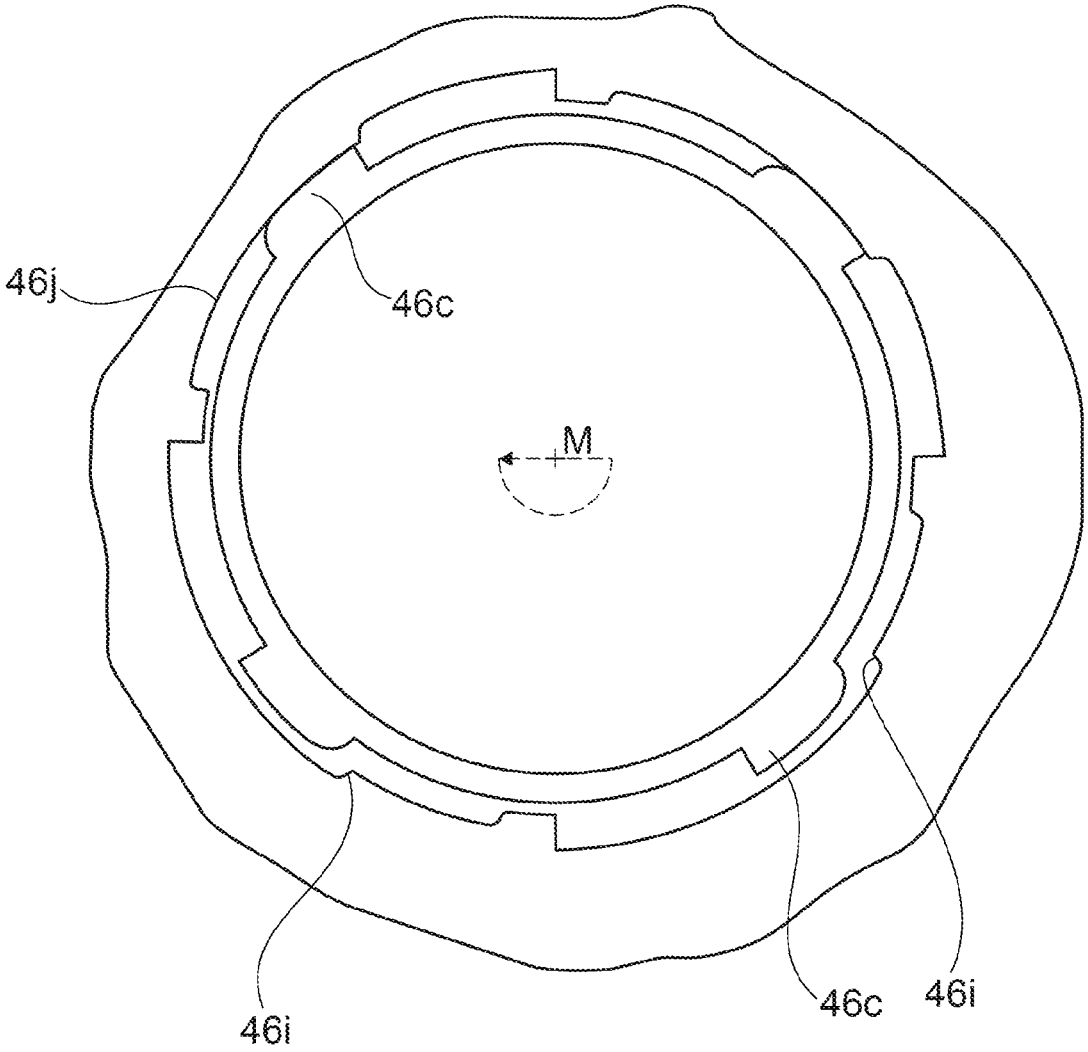

FIGS. 3A to 3B show the outer component 46*a* and the inner component 46*b* at various stages of the rotary motion of the two parts relative to one another.

The two components 46*a*, 46*b* each have a specific shape pattern. The inner component 46*b* has a circular-cylindrical outer surface, from which a plurality of projections 46*c*, in the present case four projections, project radially. In the example shown, the projections 46*c* are of the same shape and each have the same spacing with respect to the adjacent projections 46*c* in the circumferential direction. The projections 46*c* each have a rounded end and an end with a radially outward-extending side flank. The rounded end is optional; alternatively, this end can have a chamfer, for example. Together with stops 46*b* on the outer component 46*a*, this side flank prevents rotation of the inner component 46*b* relative to the outer component in one direction of rotation (clockwise in FIG. 3A)(apart from a play).

In the initial position shown in FIG. 3A (before destruction of the predetermined breaking device 43), each of the projections 46*c* is arranged in a socket 46*d*, 46*f* of the outer component 46*a*. The sockets 46*d*, 46*f* are each formed by a section with a widened radius in comparison with the stop 46*e* and with the guide sections 46*j*. In this arrangement, some (two) of the sockets 46*d* are shorter than (two) other sockets 46*f*, when measured in the circumferential direction. In FIG. 3, the shorter sockets 46*d* are situated on one half of a semicircle, while the longer sockets 46*f* are situated on the other half of the semicircle. Sockets of the same length can be adjacent in order to exploit the rotor orbit and to enable the components 46*a* and 46*b* to be rotated relative to one another. The inner component 46*b* is aligned coaxially with the outer component 46*a*. In the radial direction, the projections 46*c* and the regions between the projections 46*c* each have a spacing D1, D2 with respect to the outer component 46*a* (see also FIG. 2). This enables the bearing 41 to be moved radially after the destruction of the predetermined breaking device 43. Owing to an unbalance, the shaft 26 and hence the bearing 41 and the inner component 46*b* perform an orbiting motion.

If rotation relative to the outer component 46*a* is imparted to the inner component 46*b* by the clutch 45, the projections

46*c* are shifted within the sockets 46*d*, 46*f* until the projections 46*c* arranged in the shorter sockets 46*d* strike against a step 46*i* (in each case with the rounded end), this being indicated in FIG. 3A by an arrow. At the steps 46*i*, the radius decreases relative to the sockets 46*d*. The other projections 46*c* are then spaced apart from corresponding steps 46*i* of the longer sockets 46*f* (in the circumferential direction). As a result, the projections 46*c* are pushed radially inward at the shorter sockets 46*d*. Moreover, the revolving unbalance and the associated radial deflection of the rotor causes the inner component 46*b* to be deflected into a 7 o'clock position relative to the outer component 46*a*. The center of the inner component 46*b* is displaced relative to the center M of the outer component 46*a*, this being illustrated in FIG. 3A by an arrow starting from the center M.

Further rotation of the inner component 46*b* leads to an arrangement in accordance with FIG. 3B. The projections 46*c* raised from the short sockets 46*d* each rest against a guide section 46*j* adjoining the respective socket 46*d*. The rotation can be counteracted by friction on the guide sections 46*j*. This guide section 46*j* is therefore optionally provided with a friction-reducing coating and/or polished in a section adjoining the step 46*i*. The other projections 46*c* are still arranged in the associated sockets 46*f*. In this position, an orbiting motion of the shaft 26 is still possible but is limited as compared with the position shown in FIG. 3A. The path which the center of the inner component 46*b* can travel during the rotation is illustrated by an arrow and a dashed line and describes a semicircle.

A further rotation causes the projections 46*c* in the long sockets 46*f* to come into contact with the steps 46*i* delimiting the sockets 46*f*. The steps 46*i* are each adjoined by a guide section 46*j*, which can likewise be provided with a friction-reducing coating and/or can be polished in a section adjoining the step 46*i*. It is also possible for (all the) steps 46*i* to be provided with a friction-reducing coating and/or to be polished or, alternatively or in addition, to be rounded in order to facilitate further inward rotation.

Figure 3C:
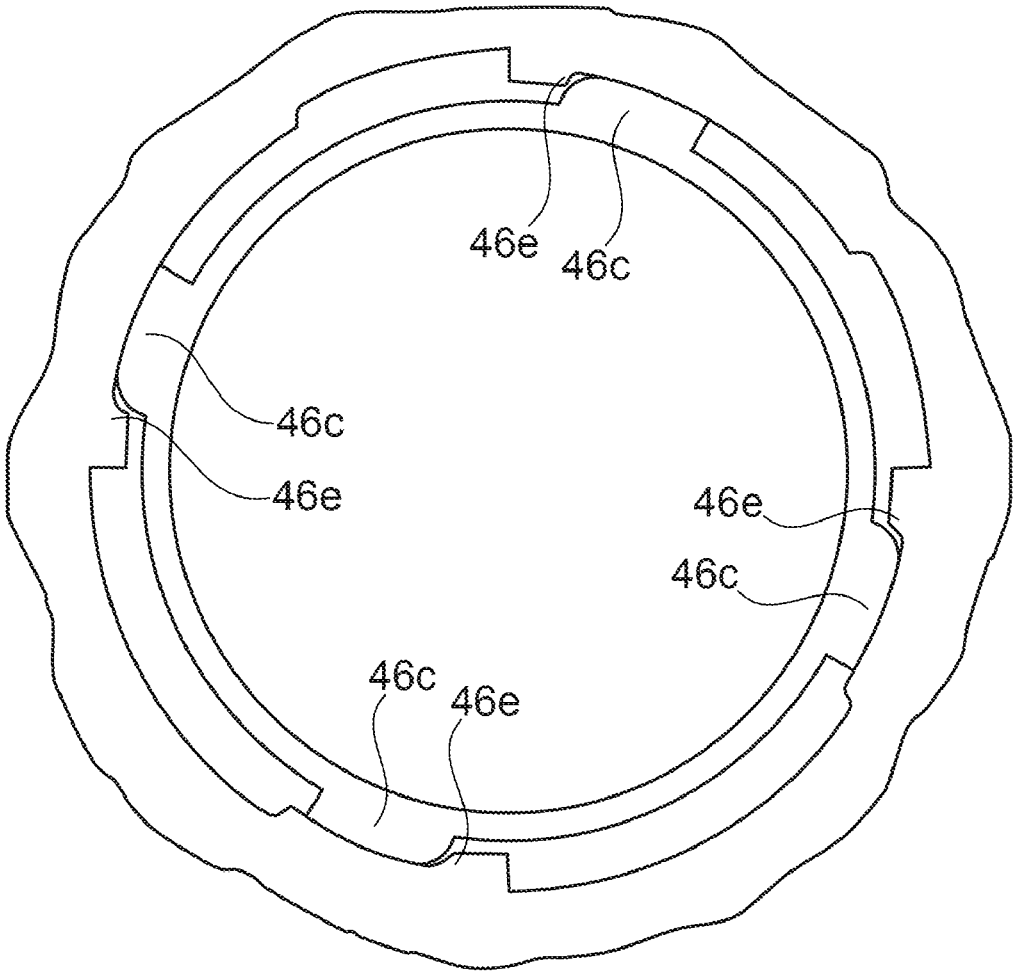

Further rotation leads to a position in accordance with FIG. 3C. In this figure, all (four) projections 46*c* have been pushed against radially constricted sections in the form of the stops 46*e*. The stops 46*e* prevent further rotation of the inner component 46*b*. As shown in FIG. 3C, the stops 46*e* optionally have a (rounded) shape matched to the projections 46*c*. Here, the shape is a matter of free choice (e.g. as a chamfer).

If the projections 46*c* of the inner component 46*b* are situated in the guide sections 46*j* and against or close to the stops 46*e*, a secure joint is furthermore formed with the outer component 46*a*. The joint can be embodied in various ways here. Among the possibilities are a frictional joint (see especially FIG. 3A), a positive joint (see especially FIGS. 4A and 4B), an interference fit and/or similar. Thus, the inner component 46*b* is fixed on the outer component 46*a*. The fixing device 46 thus fixes the bearing bracket 42 on the connecting element 44 again. This increases the resonant frequency of the shaft 26.

The clutch 45 will continue to apply a torque to the inner component 46*b* until the clutch plates 45*a*, 45*b* have worn. A further axial movement of the bearing 41 is then prevented by snubbers, which are not illustrated in the figures. These snubbers also prevent rotation of the bearing bracket 42 relative to the connecting element 44 about the main axis of rotation 9. The snubbers are arranged offset in the circumferential direction with respect to shear pins 43*a*, for example. The remainder of the engine structure can also limit a movement of the bearing bracket 42.

The specific shape pattern of the components 46*a*, 46*b* of the fixing device 46 divides the inward rotation process into several sections, thereby making it possible to minimize an opposing friction. It is furthermore possible here to actively use the orbiting motion of the shaft 26.

In the region of the stops 46*e*, the guide sections 46*j* optionally have a friction-increasing coating and/or are roughened. This prevents unintentional reverse rotation of the inner component 46*b*.

Figure 4A:
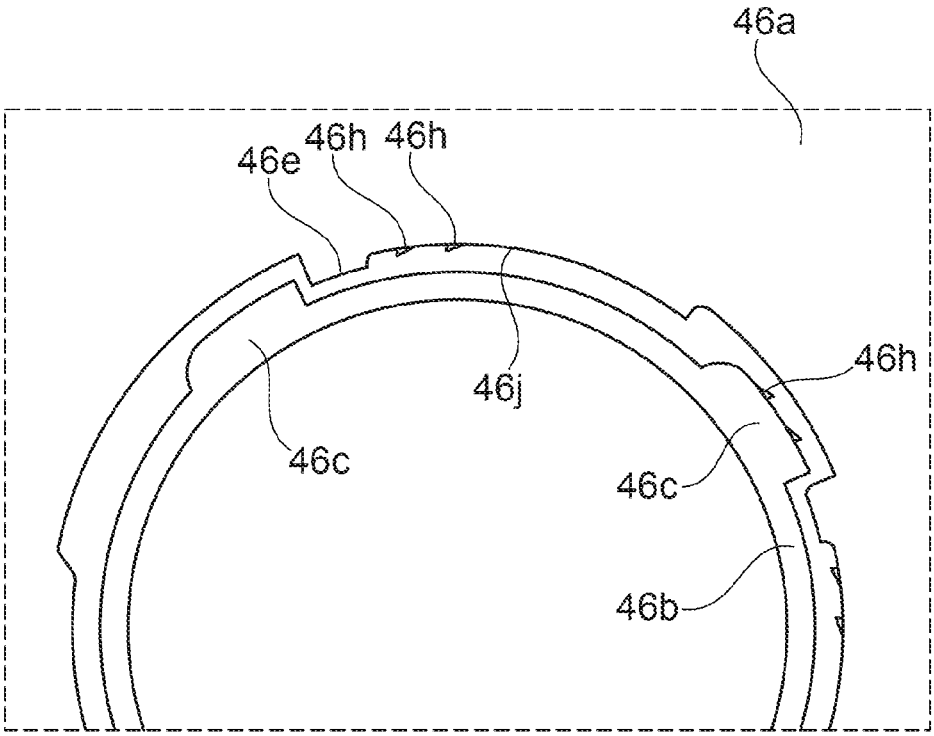
FIGS. 4A and 4B show embodiments of a fixing device with optional positive engagement elements.

As an alternative or in addition to a friction-increasing coating and to roughening, positive engagement elements 46*h* can be employed, as illustrated in FIG. 4A. Hooks or ramps directed toward the stop 46*e* can be formed on each of the guide sections 46*j* in the region of the stops 46*e*. As an option, hooks or ramps aligned in the reverse direction can be formed on the projections 46*c*. These positive engagement elements 46*h* can be latched with one another, and can be deformed plastically or elastically in the process. Positive engagement without deformation is also possible here. These positive engagement elements 46*h* optionally have a size in the millimeter range or in the submillimeter range.

Figure 4B:
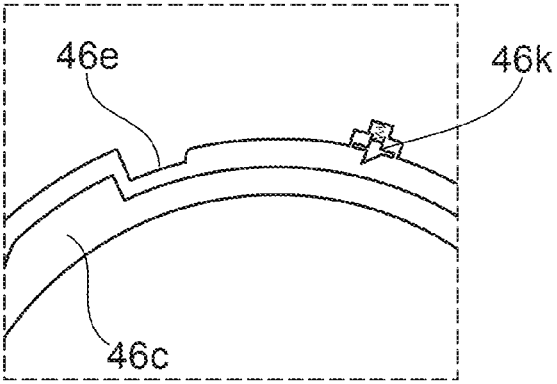

FIG. 4B shows an optional latching element 46*k*. The latching element 46*k* is arranged adjacent to a stop 46*e* on the guide section of the outer component 46*a*, more specifically in a radially outward-extending depression. The latching element 46*k* is at a distance from the stop 46*j* such that a projection 46*c* can be fixed between the latching element 46*k* and the stop 46*j*. The latching element 46*k* comprises a unilateral insertion bevel and is preloaded radially inward in a resilient manner. Thus, the projection 46*c* can push the latching element 46*k* (radially outward) and then latch therewith. The fixing device 46 can comprise a plurality of these latching elements 46*k*.

The bearing 41 is supplied continuously with lubricant (in the present case oil). A lubricant channel can be seen on the radially outer side of the stator 41*a* in FIG. 2. From there, a lubricant feed in the form of a channel 48 for oil extends as far as the mutually facing surfaces of the inner component 46*b* and of the bearing bracket 42. In this way, lubricant is compressed between them, with the result that the inner component 46*b* can be rotated without hindrance relative to the outer component 46*a* in the event of an overload. In order to avoid losing any lubricant during normal operation, the bearing assembly 40 can comprise a plurality of sealing elements 49, e.g. O-rings.

The clutch 45 and the fixing device 46 are surrounded by a lubricant trough, thus enabling these parts to be supplied with lubricant (via the bearing 41 and/or a squeeze oil film damper). One or more outflow channels 51 are provided adjacent to the first clutch disk 45*a* (in the bracket thereof). This enables lubricant to be discharged into the bearing chamber sump, even if the clutch 45 has been activated. At least one outflow channel 51 is also provided in the connecting element 44. This allows excess lubricant to flow off.

As an alternative or in addition to a lubricant supply involving oil, a permanent lubricant can be applied during the assembly of the bearing assembly 40, in particular internally to the inner component 46*p* and/or to the outer circumference of the bearing bracket 42 supporting the inner component 46*b*.

Figure 5:
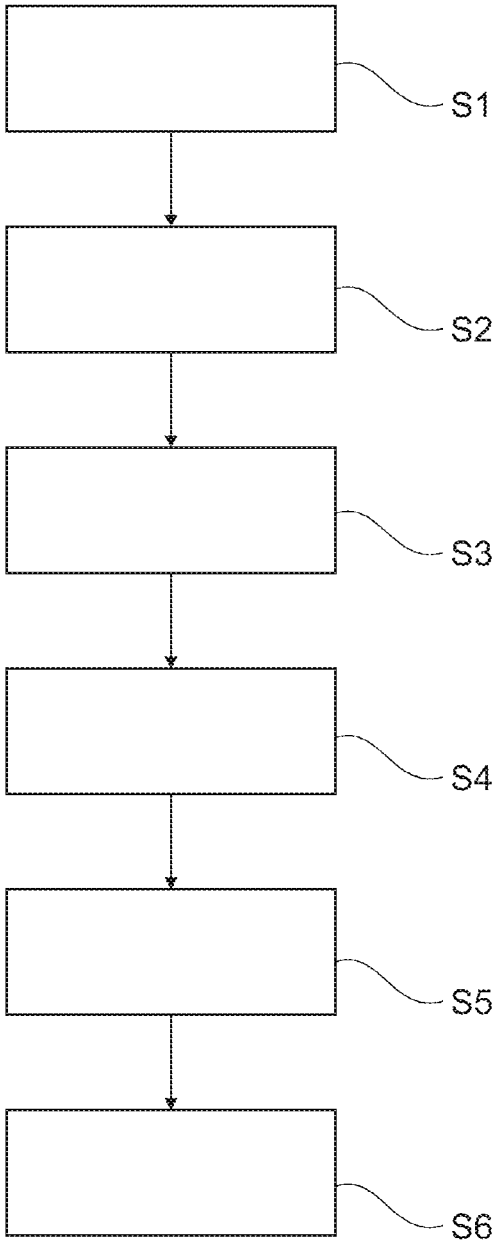
FIG. 5 shows a method for producing a bearing assembly for a gas turbine engine.

FIG. 5 shows a method for producing the bearing assembly 40 shown in FIGS. 1 to 3C and, optionally, FIG. 4A or 4B. The steps can but do not necessarily have to be carried out in the order described below.

In a first step S1, the bearing 41, with the stator 41*a* and the rotor 41*b* rotatable relative thereto, and the bearing bracket 42, which holds the stator 41*a* and is secured on the connecting element 44 by the predetermined breaking device 43, are first of all made available.

In a second step S2, the clutch 45 for transmitting a torque from the first clutch plate 45*a* connected in a fixed manner to the rotor 41*b* of the bearing 41 to the second clutch plate 45*b* supported on the bearing bracket 42 is arranged in such a way that the clutch plates 45*a*, 45*b* are spaced apart when the predetermined breaking device 43 is intact and can be brought into contact with one another by destruction of the predetermined breaking device 43.

In an optional third step S3, a period of time from destruction of the predetermined breaking device is specified (e.g. 10 seconds for some types of gas turbine engine).

In an optional fourth step S4, forces acting on the clutch after the destruction of the predetermined breaking device are specified, e.g. axial forces, especially those due to the action of the low-pressure turbine 19 and/or parameters associated with such forces, e.g. an incident flow surface of a fan, a typical airspeed, air density and/or a dynamic pressure.

In an optional fifth step S5, a wearing element 47 is made available, which is structured and dimensioned in such a way that it has worn away after a period of time corresponding to the specified period of time when the forces which act on the clutch 45 after the destruction of the predetermined breaking device 53 take effect. The fifth step S5 is optionally carried out together with the third step S3.

In an optional sixth step S6, the wearing element 47 is arranged between the clutch plates 45*a*, 45*b*.

As an option, the contour between the outer component 46*a* and the inner component 46*b* is matched to the gas turbine engine 10 by fixing the number of projections 46*c* and sockets (pockets) 46*d*, 46*f*, configuration of the lengths of the sockets and of the guide sections, detailing of the sliding surfaces between the projections 46*c* and guide sections 46*j* and coatings 46*g*, and/or fixing components which prevent the reverse rotation of the inner component 46*b* (preventing detachment after reconnection, e.g. as shown in FIG. 4A or 4B). This can take place in accordance with a specified typical unbalance due to a blade loss, for example.

Figure 6:
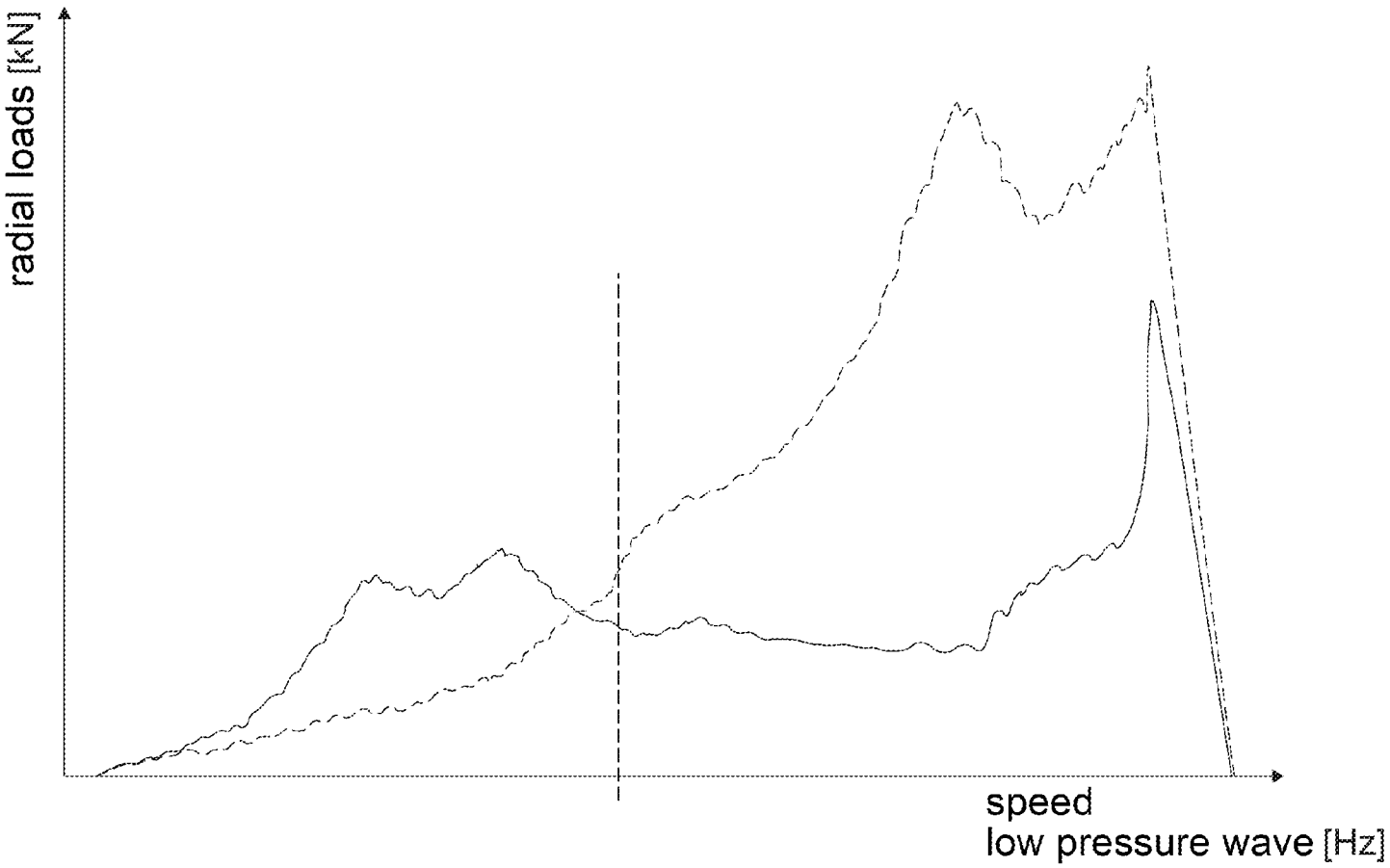
FIG. 6 shows a schematic diagram of loads on a shaft after the loss of a fan blade of a gas turbine engine.

FIG. 6 shows schematically the radial loads due to a loss of a fan blade during the operation of an illustrative gas turbine engine. A dashed line illustrates a comparison case, in which the fan bearing does not have a predetermined breaking device. Beginning with the highest speeds, very high loads are introduced into the support structure via the bearing. By virtue of the fixed connection, the unbalance due to the blade loss has severe effects, even with the successively decreasing speed (due to engine shutdown after the blade loss).

In comparison, the solid line illustrates a case with a predetermined breaking device. The destruction of the predetermined breaking device ensures that the radial loads introduced into the support structure are significantly lower. Due to the detachment of the bearing adjacent to the fan, however, the shaft has a different resonant frequency from normal operation. At relatively low speeds, as shown in FIG. 6, this leads to a renewed rise in the radial loads, particularly in the form of severe vibration. In many cases, the resonant frequency is in the range of the speeds which are typically reached in flight owing to the air pressure against the fan of the deactivated gas turbine engine (in the case of some gas turbine engines in the range of 20 to 30 Hz, for example).

By means of the above-described bearing assembly 40, the gas turbine engine 10 having a bearing assembly 40 of this kind for load reduction, and the method for producing the bearing assembly 40, it is possible to reconnect the bearing 41 to the support structure 28 after a time delay following the severing of the shear pins and thus to change the resonant frequency again, in particular to increase it (optionally to the previous value). In this case, appropriate timing can allow particularly low loads. The period of time up to reconnection can be adjusted, in particular, by means of the thickness of the wearing element. It is thereby possible for the bearing 41 of the slowing shaft 26 to be centered and fixed on the support structure 28 after the most severe loads have died down and before the resonant range is reached (e.g. at the position of the vertical dashed straight line in FIG. 6). As a consequence, it is possible to construct the backup bearing 52 and/or parts of the support structure 28 with a lower outlay on materials while supporting the shaft 26 in a particularly reliable manner.

It is self-evident that the invention is not restricted to the embodiments described above and that various modifications and improvements can be made without deviating from the concepts described here. Any of the features can be used separately or in combination with any other features, as long as these are not mutually exclusive, and the disclosure extends to all combinations and subcombinations of one or more features which are described here and includes these.

In particular, the bearing 41 can be a fixed bearing or a floating bearing. As an alternative or in addition, another of the bearings 52, 53 of the shaft 26 can be provided with the clutch 45 and the fixing device 46 or, as an alternative or in addition, a bearing of another shaft of the gas turbine engine 10, e.g. of the connecting shaft 27.

LIST OF REFERENCE SIGNS

9 main axis of rotation
10 gas turbine engine
11 core engine
12 air inlet
14 compressor
16 combustion device
17 high-pressure turbine
18 bypass thrust nozzle
19 low-pressure turbine
20 core thrust nozzle
21 engine nacelle
22 bypass duct
23 fan
26 shaft
26*a* connecting element
27 connecting shaft
28 support structure
40 bearing assembly
41 bearing
41*a* stator
41*b* rotor
42 bearing bracket
43 predetermined breaking device
43*a* shear pin
44 connecting element
45 clutch
45*a* first clutch plate (first clutch element)
45*b* second clutch plate (second clutch element)
46 fixing device
46*a* outer component
46*b* inner component
46*c* projection
46*d* socket (short)

46*e* stop
46*f* socket (long)
46*g* coating
46*h* positive engagement element
46*i* step
46*j* guide section
46*k* latching element
47 wearing element
48 lubricant feed
49 sealing element
50 lock
51 outflow channel
52 bearing (backup bearing)
53 bearing
A core air flow
B bypass air flow
D1, D2 clearance
M center

The invention claimed is:

1. A bearing assembly for a gas turbine engine, comprising:
- a bearing having a stator and a rotor rotatable relative thereto;
- a bearing bracket, which holds the bearing;
- a connecting element including an annular, projecting extension configured to be connected to a support structure of the gas turbine engine,
- a predetermined breaking device including at least one shear pin and being secured on the connecting element; and
- a clutch for transmitting a torque from a first clutch element connected in a fixed manner to the rotor of the bearing to a second clutch element supported on the bearing bracket, wherein the first and second clutch elements are spaced apart when the predetermined breaking device is intact and are brought into contact with one another by destruction of the predetermined breaking device via shearing of the at least one shear pin.

2. The bearing assembly according to claim 1, and further comprising a wearing element, which is configured to engage at least one chosen from the first and second clutch elements, is arranged between the first and second clutch elements and is made from a material and having a thickness which will wear away when in engagement with the at least one chosen from the first and second clutch elements.

3. The bearing assembly according to claim 1, further comprising a fixing device for fixing the bearing bracket on the connecting element, the fixing device being drivable by the clutch.

4. The bearing assembly according to claim 3, wherein the fixing device comprises an outer component and an inner component arranged within the outer component.

5. The bearing assembly according to claim 4, wherein the inner component is rotatable relative to the outer component via the clutch when the first and second clutch elements are in contact with one another.

6. The bearing assembly according to claim 4, wherein the inner component includes a projection, and the outer component includes at least one socket for receiving the projection.

7. The bearing assembly according to claim 6, wherein the projection is configured to push against a stop of the outer component by rotation of the inner component relative to the outer component to fix the bearing bracket on the connecting element.

8. The bearing assembly according to claim 7, wherein the projection and the stop and/or a region of the outer component which is adjacent to the stop, are configured to fix the inner component frictionally and/or positively on the outer component.

9. The bearing assembly according to claim 7, wherein the outer component includes a coating and/or positive engagement elements in a region of the stop.

10. The bearing assembly according to claim 6, wherein the at least one socket includes two or more sockets having different lengths from one another when viewed in a circumferential direction.

11. The bearing assembly according to claim 6, wherein the at least one socket includes a plurality of sockets of a same length arranged adjacent to one another.

12. The bearing assembly according to claim 4, wherein the second clutch element is connected in a fixed manner to the inner component or is formed thereon, and, after the destruction of the predetermined breaking device, the inner component is supported rotatably on the bearing bracket.

13. The bearing assembly according to claim 4, and further comprising a lubricant feed configured to introduce lubricant between the inner component and the bearing bracket.

14. A gas turbine engine for an aircraft, comprising:
- a fan,
- a shaft, by which the fan is driven, and
- the bearing assembly according to claim 1, wherein the bearing of the bearing assembly supports the shaft.

15. A method for producing a bearing assembly for a gas turbine engine, comprising the following steps:
- providing a bearing assembly for a gas turbine engine, comprising:
  - a bearing having a stator and a rotor rotatable relative thereto;
  - a bearing bracket, which holds the bearing;
  - a connecting element including an annular, projecting extension configured to be connected to a support structure of the gas turbine engine,
  - a predetermined breaking device including at least one shear pin and being secured on the connecting element; and
  - a clutch for transmitting a torque from a first clutch element connected in a fixed manner to the rotor of the bearing to a second clutch element supported on the bearing bracket;
- providing that the first and second clutch elements are spaced apart when the predetermined breaking device is intact and are brought into contact with one another by destruction of the predetermined breaking device via shearing of the at least one shear pin.

16. The method according to claim 15, further comprising:
- specifying a period of time from destruction of the predetermined breaking device;
- specifying forces acting on the clutch after the destruction of the predetermined breaking device; and
- providing a wearing element, which is configured to engage at least one chosen from the first and second clutch elements and which is made from a material and having a thickness which will wear away when in engagement with the at least one chosen from the first and second clutch elements after a period of time corresponding to the specified period of time when the forces which act on the clutch after the destruction of the predetermined breaking device take effect.

* * * * *